United States Patent [19]

Pease

[11] 4,429,804

[45] Feb. 7, 1984

[54] RE-SEALER FOR TAB-RETAINING POP-TOP CANS

[76] Inventor: Gerald F. Pease, 10622 Prospect Ave., Santee, Calif. 92071

[21] Appl. No.: 386,545

[22] Filed: Jun. 9, 1982

[51] Int. Cl.[3] ..... B65D 45/00

[52] U.S. Cl. ..... 220/247; 220/243; 220/251

[58] Field of Search ..... 220/234, 238, 243, 247, 220/250, 251

[56] References Cited

U.S. PATENT DOCUMENTS 3,019,950 2/1962 Callegari ..... 220/251

3,727,787 4/1973 Gregory ..... 220/243

3,982,656 9/1976 Kusmierski et al. ..... 220/238

*Primary Examiner*—George T. Hall

*Attorney, Agent, or Firm*—Ralph S. Branscomb

[57] ABSTRACT

A beverage can re-sealer is provided which is functional on both the cans with the removable tab and the more recent type of can in which the pull tab remains with the can after it is opened. The re-sealer has a covering body which covers both the pouring hole and the opener tab, and defines a resilient lip surrounding both of these items, with a cam-actuated depending foot which is inserted through the pouring hole and rotated so that the foot grips the can lid alongside the hole, subsequent to which it is cammed up tightly against the surface, bringing pressure to bear on the sealing lip.

3 Claims, 12 Drawing Figures

RE-SEALER FOR TAB-RETAINING POP-TOP CANS

BACKGROUND OF THE INVENTION

The inventor owns and operates a small company which owns the patent rights to a Pop-top Can Re-sealer, U.S. Pat. No. 3,727,787. The can re-sealer disclosed in the above referenced patent was produced and sold for almost ten years, and is still being sold in reduced quantities in the United States and even more so, in foreign countries.

In the last few years, states have increasingly passed legislation prohibiting or limiting the use of the pop-top cans with removable opener tabs. In some states, the prolifieration of the little tabs became very offensive to environmentally conscious citizens. In many areas, metal detectors are virtually useless because they are in a constant state of being triggered due to the presence of pop-tops in the top few inches of the soil. It has been said that if present civilization destroys itself, future species will at least be able to learn a little about us through out pop-tops.

Although the passage of environmental legislation such as the prohibition of removable pop-tops is a thrill for environmentalists, it was less than a thrill to the instant inventor, inasmuch as the improvement in his aesthetic life due to the imperceptible decrease in pop-top tab litter did not make up for the bottom dropping out of the re-sealer business. The old re-sealers just would not work on the new cans because the tab which remained with the can interfered with the sealing action of the rubber foot of the re-sealer.

SUMMARY OF THE INVENTION

In order to reconcile man's aesthetic craving for freedom from pop-top litter with man's need to eat, applicant has developed a re-sealer which accommodates the little tab that sticks up from the top of the pop-top can. This involved overcoming two main problems. First, some type of cavity had to be provided which accommodated the pull-top tab, and second, some type of clamp needed to be developed which would not conflict with the teardrop-shaped piece of metal which folds inside the can when the can is opened.

Basically, the inventor utilizes a rigid plastic plate which backs a resilient rubber-like pad that defines a lip surrounding both the pop-top tab and the pouring opening. The pad and plate both define a clearance opening to accommodate the tab.

The plate and pad structure form a body which is held in place by a clamp comprising a depending stem with a laterally extended foot, which will rotate to engage the can alongside the pouring opening. Once so engaged, a cam-action lever connected to the top of the stem is flipped into locking position, which cams the stem upward, applying pressure against the lip to compress same against the top of the can.

DETAILED DESCRIPTION OF THE PREFERRED EMBODIMENT

Figure 6:
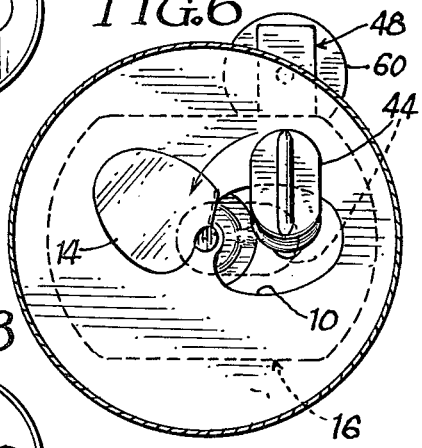
FIG. 6 is a view similar to that of FIG. 5 illustrating the foot in locking position.
Figure 9:
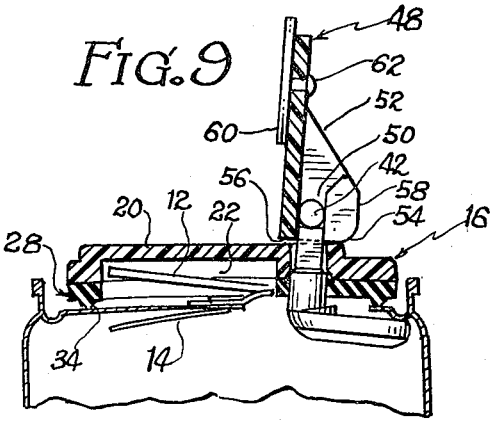
FIG. 9 is a section taken along line 9—9 of FIG. 2.

The new style cans with the pop-tops which remain with the can after it is opened have a pear-shaped opening 10, as best shown in FIG. 6, an actuator tab 12, which as best seen in FIG. 9, remains with the can extending upward at a slight angle when opened, and the apple-shaped cutout 14 which previously occupied what is now the pouring hole. This scrap of metal hangs down inside the can, attached to the lid along one short edge portion.

The re-sealer is made of four molded parts, not counting the advertising tab. Of these parts, three are rigid plastic and the fourth is made of a resilient, rubbery plastic to define the sealing element.

Figure 11:
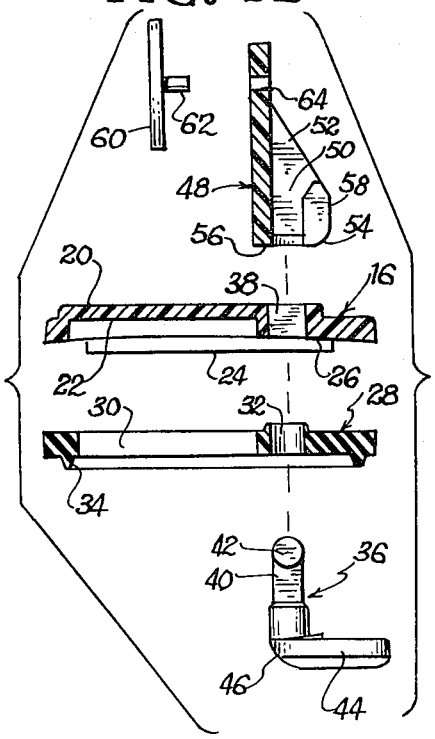
FIG. 11 is an exploded side elevation view of the re-sealer.
Figure 12:
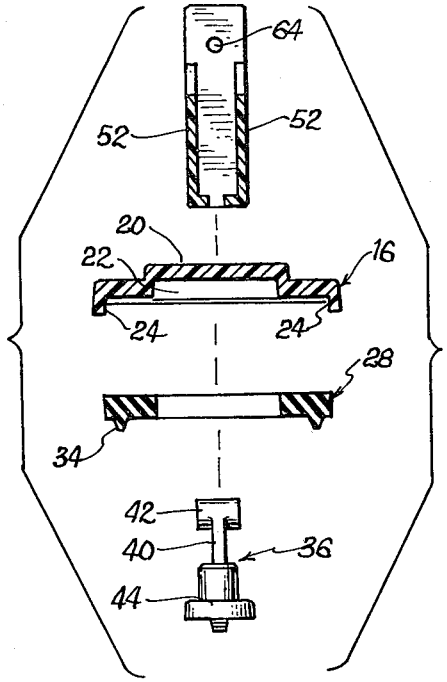
FIG. 12 is an exploded end elevation view of the re-sealer.

These elements are best shown in FIGS. 11 and 12. At the core of the re-sealer is a backing plate 16 whose ends are circular arcs corresponding to the edge of a can, with flat sidewalls 18 connecting the two arc ends. The plate is generally flat, with a raised central portion 20 which defines clearance cavity 22 in the plate. Extending from each of the flat edges 18 of the plate are retaining ridges 24 which nest the resilient sealing pad therebetween. Between these ridges lies a wide expanse which comprises the resilient pad support surface. This surface is generally contoured to fit the usually slightly convex top of a typical beverage can, although it may be straight in the lateral dimension because in such a short run the can contour can be accommodated by the resilience in the sealing pad.

The sealing pad itself is indicated at 28. This resilient, rubbery member is a generally planar piece with central clearance cavity 30 cut out adjacent the clamp stem hole 32. The non-planar feature of the sealing surface of this pad is a continuous rather sharp lip 34 following the perimeter of the pad. This pad lies between the parallel spaced retaining ridges 24, and is retained in place against the supporting surface 26 of the backing plate 16 by the retainer clamp 36 which passes up through the hole 32 and an aligned hole 38 in the support plate.

The retainer clamp consists of a stem 40 which has a T-bar 42 on the top which forms trunnion-like projections, and a foot 44 at the bottom. The foot is contoured for general clearance purposes, and has a heel 46 that is deliberately largely contoured to permit the foot to be inserted into the narrower, teardrop-shaped openings of the old style cans with removable pop-tops.

Figure 10:
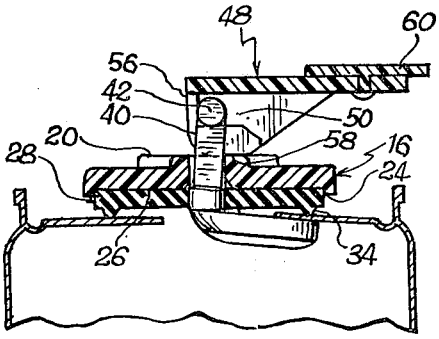
FIG. 10 illustrates the re-sealer installed on an old style can.

The actuator lever 48 at its proximal end defines hollows 50 which seat the T-bar projections of the stem. The sidewalls 52 of the lever which define the hollows in part also define a cam 54, which connects the two flattened surfaces 56 and 58 which represent the loose position and the tight position, respectively, of the clamp. FIGS. 9 and 10 illustrate these two different positions.

Due to the careful design of the re-sealer, like its predecessor, this re-sealer requires no bonding agents or fasteners as it all neatly interlocks together into a functioning unit. Once the stem is inserted through the stem openings in the resilient pad and its backing plate, the T-bar top is engaged by the actuator lever so that the retainer clamp holds all of the parts together.

One further element, which is optional, is an actuator assist panel 60, shown as a disc. This disc has an extending nipple 62 which extends through the mounting hole 64, where it can be permanently mounted by expanding the tip of the nipple with the quick touch of a hot element. Although this disc assists the operation of the actuator lever somewhat, its principal function is to display advertising on its top surface. By utilizing the separate disc for the advertising, the rest of the unit can be made independent of considerations of the size and shape of advertising copy, with the add-on panel being adapted at will in size and shape to accommodate any particular message.

Figure 1:
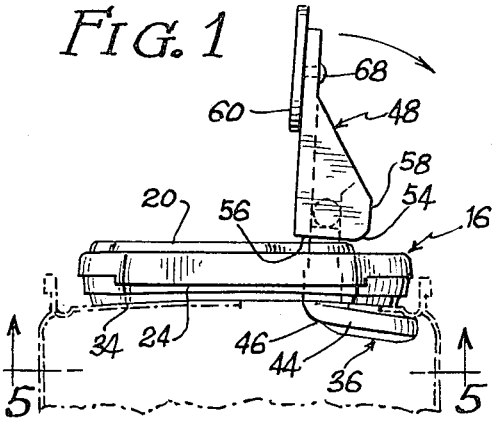
FIG. 1 is a side elevation view of the re-sealer showing the top of a can in phantom.
Figure 2:
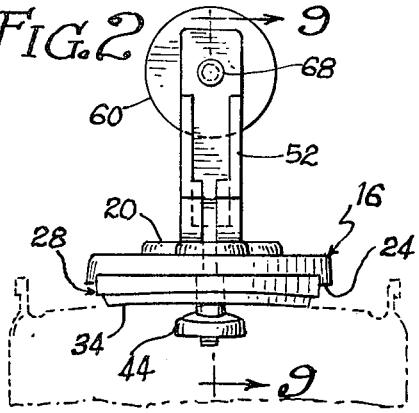
FIG. 2 is an end elevation view of the re-sealer shown in FIG. 1 illustrating the can in phantom.
Figure 3:
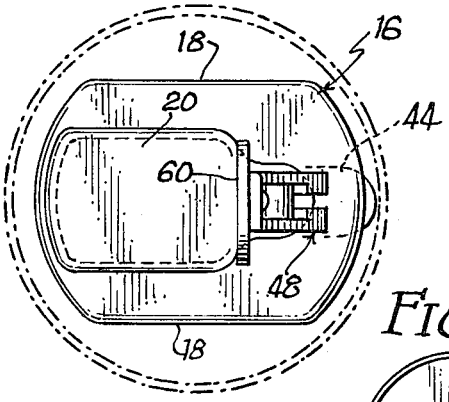
FIG. 3 is a top elevation view of the re-sealer in place on a phantom can which has not been locked tight yet.
Figure 4:
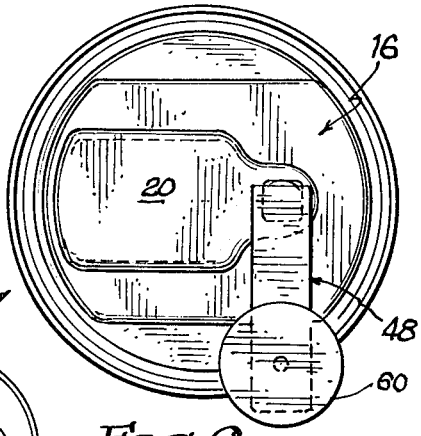
FIG. 4 is a top elevation view similar to that in FIG. 3, but illustrating the re-sealer after it has been sealed.
Figure 7:
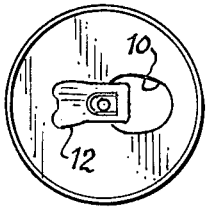
FIG. 7 is a top elevation view of a can which retains its pop-top after opening.
Figure 5:
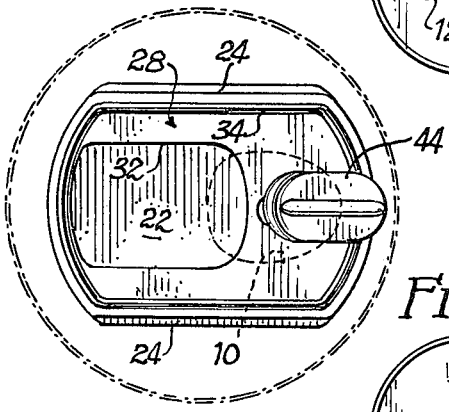
FIG. 5 is a view of the re-sealer from inside a phantom can, seen from the position as shown at line 5—5 of FIG. 1, illustating one of the better positions of the foot when the re-sealer is initially placed on the top of the can prior to sealing.

Use of the device should follow from the above description. As shown in FIGS. 1, 5 and 9, the re-sealer is most easily installed when the foot is arranged to pass through the opening 10 at its side closest to the edge of the can. Once the foot is beneath the lip of the can as shown in FIG. 9, it is then rotated, preferably as far as possible toward the direction opposite the orientation of the foot when it was inserted. At some point, the foot will run into the metal cutout 14 beneath the can lid, stopping further rotation.

At this point, depending on the position of the cutout beneath the lid, the tab will be most if not all the way into the reversed position, while the lever is still in its open position, resting on its own surface 56 atop the backing plate. By flipping the lever from the upright into the horizontal position shown in FIG. 10, the entire mechanism is tightened up, the lever being drawn tightly against the foot of the retainer clamp, compressing therebetween all of the other elements of the re-sealer as well as the lid of the can. As shown in FIG. 10, a nice tight seal is thus defined despite the presence of the tab and the cutout of the opened can.

Figure 8:
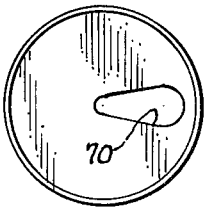
FIG. 8 is a top elevation of an old style can after it has been opened.

FIG. 8 illustrates the old style can. The re-sealer of the instant invention will work quite well on the old style can. However, because of the narrowness of the opening 70, as mentioned above, the heel 46 of the clamp foot is reduced considerably.

Thus, at long last, a solution is provided to the long-standing conflicts between the needs of the environment and the needs of those who like to keep the fizz in their half empty cans of beer and soda pop. In addition, the need of the inventor to but bread on his table and make his mortgage payments has been at least partially met.

While the preferred embodiment of the invention has been described, other modifications may be made thereto and other embodiments may be devised within the spirit of the invention and scope of the appended claims.

What is claimed is:

1. A re-sealer for a beverage can of the type in which the opener tab remains with the can alongside the pouring hole in the lid after opening, said re-sealer comprising:

(a) a cover body defining a continuous sealing lip dimensioned to encircle both said pouring hole and said tab;

(b) said body defining a cavity to provide clearance for said tab;

(c) a stem with a laterally extended foot at the bottom for extending into said hole and under a portion of said lid alongside said opening for a positive engagement thereof;

(d) said stem being mounted eccentrically in said body adjacent one edge of said cavity and being rotatable about its axis to swing said foot into and out of general alignment with said hole for removal and insertion of said foot through said hole, and for rotating said foot sideways to clamp under said lid; and (e) an actuator lever operatively connected to the upper end of said stem to selectably draw said foot up against said lid, or down free thereof.

2. Structure according to claim 1 and including a grip facilitating panel mounted atop said lever, said panel has an extended nipple, and said lever has a hole therethrough for receiving said nipple to mount said panel; and said panel displays advertising indicia on the face thereof.

3. Structure according to claim 1 wherein said body comprises a flexible pad defining said lip and a rigid backing plate seating said pad; and said backing plate has a pad-supporting surface and said surface is concave in a dimension corresponding to the long dimension of said pouring hole to apply greater sealing pressure along the end regions of said pad.

* * * * *